US008436265B2

(12) United States Patent
Koike et al.

(10) Patent No.: US 8,436,265 B2
(45) Date of Patent: May 7, 2013

(54) KEYBOARD

(75) Inventors: Tamotsu Koike, Shinagawa (JP); Shuji Nakamura, Shinagawa (JP); Junichi Maruyama, Shinagawa (JP)

(73) Assignee: Fujitsu Component Limited, Tokyo (JP)

( * ) Notice: Subject to any disclaimer, the term of this patent is extended or adjusted under 35 U.S.C. 154(b) by 86 days.

(21) Appl. No.: 12/058,379

(22) Filed: Mar. 28, 2008

(65) Prior Publication Data

US 2008/0237012 A1 Oct. 2, 2008

(30) Foreign Application Priority Data

Mar. 30, 2007 (JP) ..... 2007-091024

(51) Int. Cl.
*H01H 9/00* (2006.01)

(52) U.S. Cl.
USPC ..... 200/314; 200/341

(58) Field of Classification Search .... 200/302.1–302.3, 200/344
See application file for complete search history.

(56) References Cited

U.S. PATENT DOCUMENTS

| | | | | |
|---|---|---|---|---|
| 3,971,902 | A * | 7/1976 | Wulf et al. | 200/5 A |
| 6,573,463 | B2 * | 6/2003 | Ono | 200/5 A |
| 6,586,695 | B2 * | 7/2003 | Sato et al. | 200/344 |
| 6,603,083 | B2 * | 8/2003 | Amari et al. | 200/5 D |
| 6,686,549 | B2 * | 2/2004 | Douzono et al. | 200/341 |
| 7,138,587 | B2 * | 11/2006 | Nishino et al. | 200/5 A |
| 2005/0000788 | A1 * | 1/2005 | Nishimura | 200/512 |

FOREIGN PATENT DOCUMENTS

| | | |
|---|---|---|
| EP | 0 315 910 A2 | 5/1989 |
| EP | 0 315 910 A3 | 8/1990 |
| JP | 51-71905 | 6/1976 |
| JP | 60-194827 | 12/1985 |
| JP | 1-231109 | 9/1989 |
| JP | 5-2233 | 1/1993 |
| JP | 10-63394 | 3/1998 |
| JP | 2002-216575 | 8/2002 |
| JP | 2002-251937 | 9/2002 |
| JP | 2006-269439 | 10/2006 |

OTHER PUBLICATIONS

Office Action issued by the Japanese Patent Office on Jun. 26, 2012 in the corresponding Japanese patent application 2008-084543.

* cited by examiner

*Primary Examiner* — Elvin G Enad
*Assistant Examiner* — Lisa Homza
(74) *Attorney, Agent, or Firm* — Staas & Halsey LLP

(57) ABSTRACT

The keyboard includes a rubber sheet fixed on key tops of a set of key-switch devices. The rubber sheet elastically urges the key tops upward so that they are borne away from the base of the key-switch devices. The rubber sheet is arranged so as to cover the key-switch devices from outside. According to the invention, the cost of a keyboard covered with a dustproof and watertight rubber sheet can be reduced.

6 Claims, 8 Drawing Sheets

KEYBOARD

BACKGROUND OF THE INVENTION

1. Field of the Invention

The present invention relates to a keyboard having a set of key-switch devices, and particularly it relates to a keyboard used as an input device of an electrical device.

2. Description of the Related Art

Japanese Unexamined Patent Publication (Kokai) No. 2002-216575 discloses a keyboard device having a seal member which can prevent liquid such as water from entering a contact part of each membrane switch even if the liquid is spilled from above a set of key-switch devices by mistake.

Japanese Utility Model Publication (Kokai) No. 5-2233 discloses a keyboard cover which can protect a keyboard against dust and the like, and allows a user to do a blind operation.

Further, Japanese Unexamined Patent Publication (Kokai) No. 1-231109 discloses a keyboard cover, which seals up a set of key-switch devices, but offers the same key stroke as that of a typical keyboard.

In the Patent Publication No. 2002-216575, an attempt to avoid the possibility of pressing a wrong key switch is made by disposing a key top under the seal member. However, the keyboard device has the following problems. The first is that the number of parts and the cost are increased because the keyboard device has a rubber spring for elastically urging each key top upward. The second is that the possibility of a user pressing a wrong key-switch device cannot be eliminated absolutely because the key-switch devices are covered with the seal member. In addition, it is not disclosed therein to illuminate the key-switch devices. The keyboard device also has a problem that the rubber spring for urging the key top upward blocks light from illuminating the key-switch devices.

Also, the Utility Model Publication No. 5-2233 discloses a cover for protecting a keyboard against dust. However, the structure of key-switch devices is still unknown, and it is not disclosed therein to illuminate the key-switch devices. Further, to allow a user to do a blind operation, the dustproof keyboard protection cover has a protrusion in a portion corresponding to the key-switch device of each home position. However, it just helps the user to distinguish the home position through the cover, and as to other key-switch devices, there is still the possibility of the user pressing a wrong key-switch device as in the case of the Patent Publication No. 2002-216575.

Also, the Patent Publication No. 1-231109 discloses a cover for protecting a keyboard against dust. However, the structure of key-switch devices is still unknown, and it is not disclosed therein to illuminate the key-switch devices. Further, the key-switch devices are covered with a seal member, and therefore there is the possibility of a user pressing a wrong key-switch device as in the cases of the Patent Publication No. 2002-216575 and Utility Model Publication No. 5-2233.

SUMMARY OF THE INVENTION

Therefore, it is one object of the invention to cut the cost of a keyboard covered with a dustproof and watertight rubber sheet.

It is another object of the invention to provide a keyboard which allows a user to correctly press a desired key-switch device even when the keyboard is covered with a dustproof and watertight rubber sheet.

It is the last object of the invention to provide a keyboard which illuminates a desired key-switch device even when the keyboard is covered with a dustproof and watertight rubber sheet.

To achieve the above objects, the invention provides a keyboard comprising a set of key-switch devices having a base, and each including a key top disposed above the base, a guide member located on the base for guiding the key top along up and down directions, and a switch mechanism for opening and closing a contact of an electric circuit in response to upward and downward actions of the key top; and a rubber sheet fixed on the key tops of the set of key-switch devices, which elastically urges the key tops upward so that the key tops are borne away from the base, wherein the rubber sheet is arranged so as to cover the set of key-switch devices from outside.

The keyboard eliminates the need for a rubber dome, which was needed between the contact and key top. This is because the rubber cover elastically urges the key tops upward so that the key tops are borne away from the base. Therefore, the cost can be reduced.

The keyboard may further comprise a lattice-like member disposed on the rubber sheet, which prevents the key-switch device adjacent to the desired one from being operated by mistake.

Therefore a user can press a desired key-switch device.

Also, each key top may include a push-down part for opening and closing the contact.

A push-down part for opening and closing the contact allows a user to press a desired key-switch device exactly.

The keyboard may further comprise an illuminating mechanism provided in contact with the base for illuminating the set of key-switch devices.

Therefore, light for illumination is never blocked, and the brightness of illumination can be lowered in comparison to that when a rubber dome is needed. Thus, the power consumption can be kept lower.

Also, each key top, each guide member and each push-down part may be formed from a transparent resinous material.

Therefore, light for illumination is never blocked by the above members, and the brightness of illumination can be lowered in comparison to that when the above members are not formed from a transparent resinous material. Thus, the power consumption can be kept lower.

Also, each base may be formed from a metal material and has an opening transmitting light from the illuminating mechanism.

Therefore, the illuminating mechanism can exclusively illuminate the key top. Then it is easy for a user to see the key top.

Also, each base may be formed from a resinous material and has an opening transmitting light from the illuminating mechanism.

Therefore, the illuminating mechanism can exclusively illuminate the key top. Then it is easy for a user to see the key top.

DESCRIPTION OF THE DRAWINGS

The above and other objects, features and advantages of the present invention will become more apparent from the following description of preferred embodiments in connection with the accompanying drawings, wherein.

DESCRIPTION OF THE PREFERRED EMBODIMENT

Figure 1:
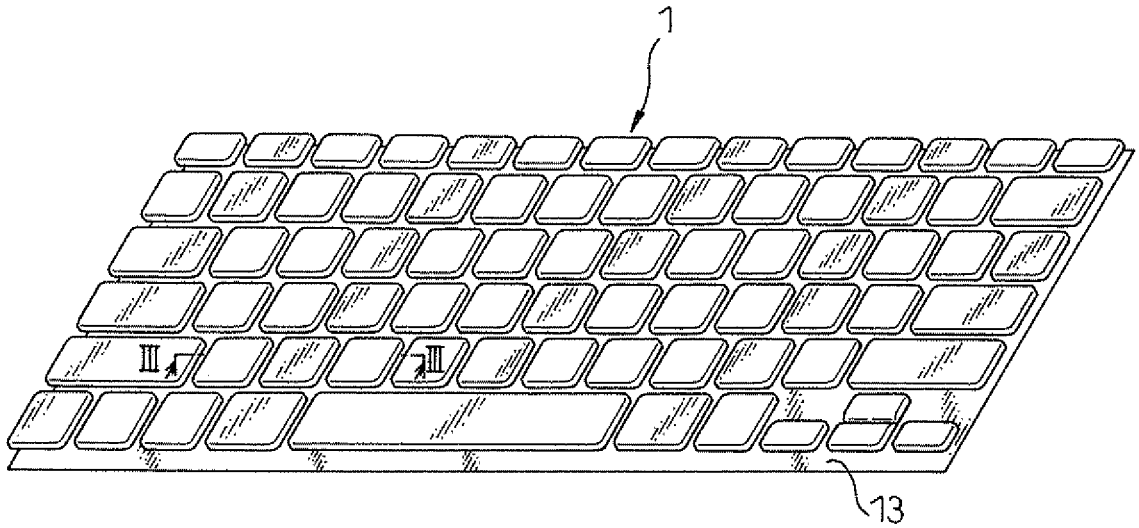
FIG. 1 is a perspective view of a keyboard 1 according to the first embodiment of the invention.

The embodiments of the present invention are described below in detail, with reference to the accompanying drawings. In the drawings, the same or similar components are denoted by common reference numerals.

Figure 2:
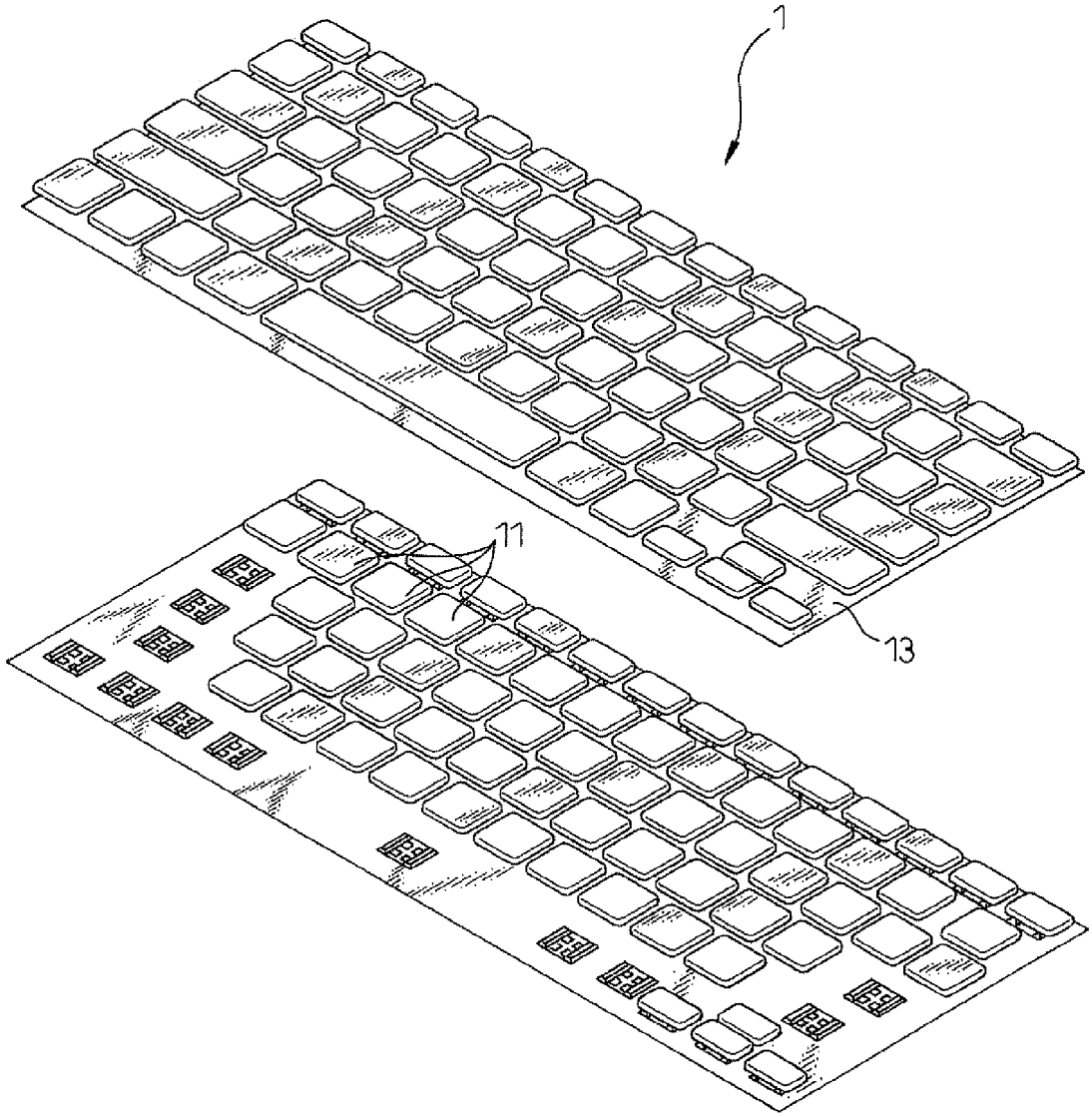
FIG. 2 is an exploded perspective view of the keyboard 1 of FIG. 1.
Figure 3:
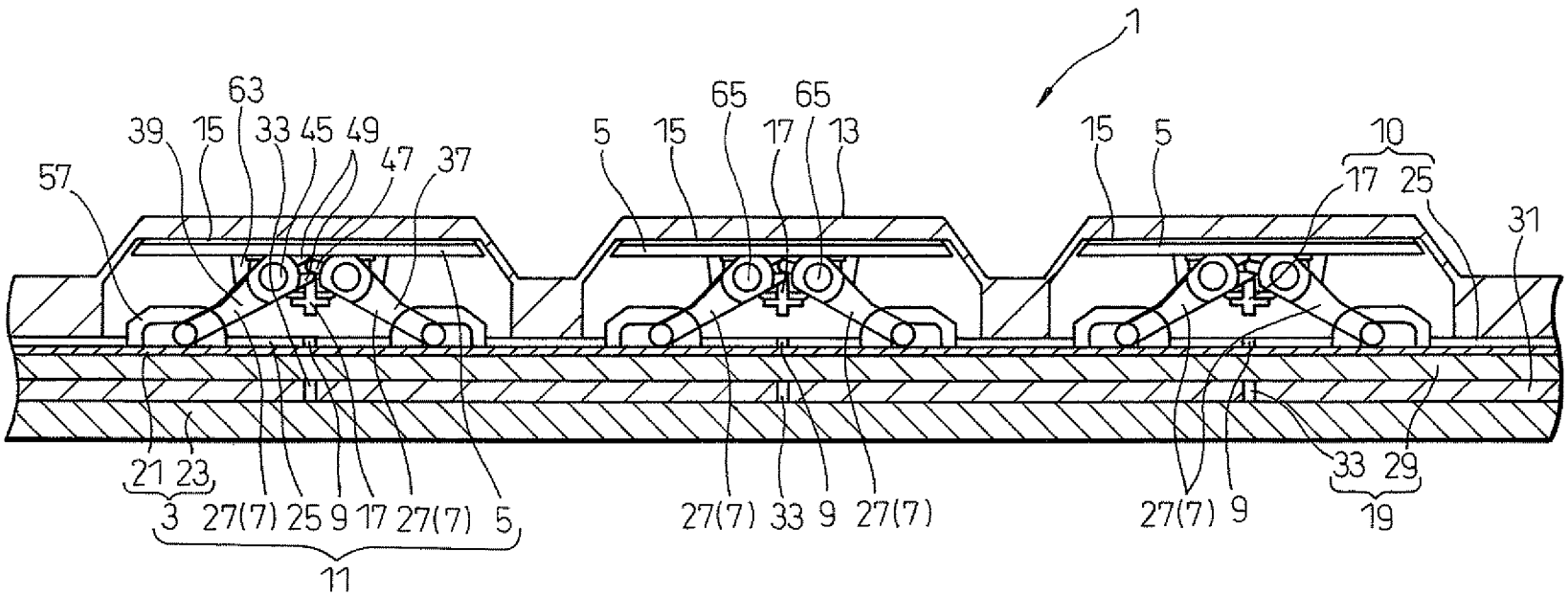
FIG. 3 is a sectional view taken along the line III-III shown in FIG. 1.
Figure 4:
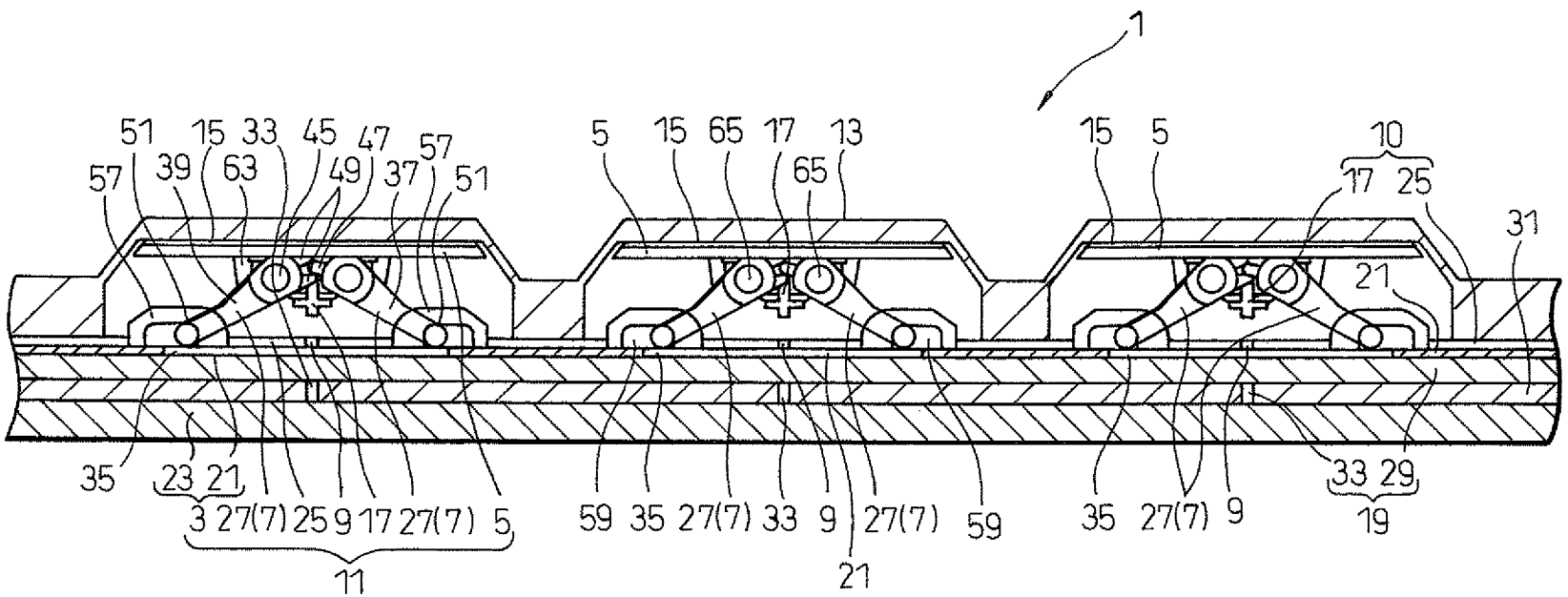
FIG. 4 is a sectional view of a modification of the keyboard, which corresponds to the drawing taken along the line III-III shown in FIG. 1; and, FIG. 5 is an exploded perspective view of one part of the key switch of FIG. 4.

Referring to the drawings, FIG. 1 is a perspective view of a keyboard 11 according to the first embodiment of the invention, and FIG. 2 is an exploded perspective view thereof. FIG. 3 is a sectional view of the keyboard taken along the line III-III shown in FIG. 1, and FIG. 4 is a sectional view of a modification of the keyboard, which corresponds to the drawing taken along the line III-III shown in FIG. 1.

The keyboard 1 includes a set of key-switch devices 11 having a base 3, and each including a key top 5 disposed above the base 3; a guide member 7 located on the base 3 for guiding the key top 5 along up and down directions; and a switch mechanism 10 for opening and closing a contact 9 of an electric circuit in response to upward and downward actions of the key top 5. Further, the keyboard 1 includes a rubber sheet 13 fixed to the key tops 5 of the set of key-switch devices 11, which elastically urges the key tops 5 upward so that the key tops are borne away from the base 3. Herein, the rubber sheet 13 is fixed to each key top 5, e.g., through an adhesive layer 15. The rubber sheet 13 is disposed so as to cover the set of key-switch devices 11 from outside. As a result, the need for a rubber dome, which was needed between the contact 9 and key top 5, is eliminated because the key top 5 is elastically urged upward so that the key top is borne away from the base 3. Thus, the cost can be reduced. Further, the keyboard 1 includes a push-down part 17 for each key top 5, which opens and closes the contact 9. Therefore, a desired key-switch device 11 can be pressed exactly because each key top 5 has the push-down part 17 for opening and closing the contact 9. In addition, the keyboard 1 includes an illuminating mechanism 19 provided adjacent to the base 3, which illuminates the set of key-switch devices 11. In addition to that the set of key-switch devices 11 can be thus illuminated, no rubber dome is needed and as such, the light for illumination is not blocked. Therefore, the brightness of illumination can be lowered in comparison to that when the rubber dome is required, and thus the power consumption can be reduced. Now, it is noted that the number of the key-switch devices 11 which the keyboard 1 has may be one.

Figure 5:
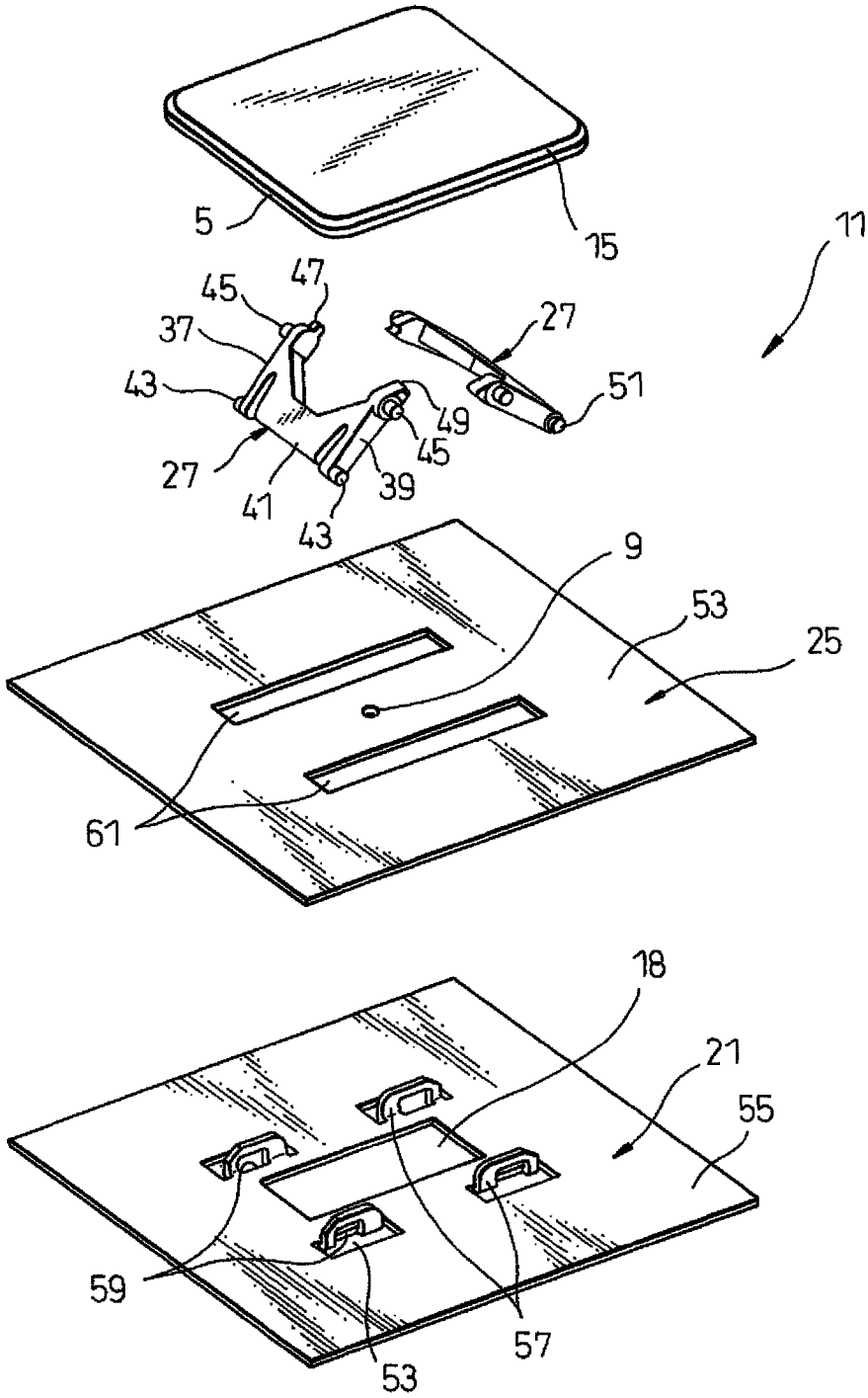

As in FIG. 3, the base 3 has a first base 21 and a second base 23; on the first base 21 is disposed a membrane switch sheet 25. The guide member 7 is a link mechanism 27 composed of a pair of parts. Under the first base 21, the illuminating mechanism 19 is located. The illuminating mechanism 19 has a light-guide plate 29, and a light source 33 disposed on, e.g., a flexible printed board 31. In the undermost position of the keyboard, the second base 23 is located. The push-down part 17 may have any form as long as it can push down the contact 9. Furthermore, the first base 21 is a rigid member in the shape of a flat plate such as a separate thin metal plate formed of a sheet metal material. As shown in FIGS. 4 and 5, the first base 21 may have an opening 35 transmitting light from the illuminating mechanism 19. Therefore, the illuminating mechanism 19 can exclusively illuminate the key top 5. Also, the membrane switch sheet 25, at least the portions overlapping with an opening 35 of the first base 21, may be formed from a transparent or semi transparent resinous material. Therefore, light from the light source 33 is never blocked.

A pair of link mechanism 27 have shapes and dimensions identical to each other, and are assembled together into a reverse V-shape as seen in a lateral direction or a side view, and meshed at one of the end regions thereof with each other in a gearing manner. Each link mechanism 27 is formed as, e.g., an integrally molded unitary piece made of a resinous material. The link mechanism 27 includes integrally a pair of arms 37, 39 extending generally parallel to each other and a trunk 41 interconnecting the arms 37, 39 with each other. In the illustrated embodiment, in each of the link mechanisms 27, the end regions of the arms 37, 39 adjoining the trunk 41 are defined as a first end region of the link mechanism 27, and the end regions of the arms 37, 39 extending in the same direction from the trunk 41 are defined as a second end region of the link mechanism 27.

In the first end region of each link mechanism 27, a pair of sliding axles 43 constituting a sliding part project coaxially with each other from the mutually facing-away outer sides of the arms 37, 39 and oppositely to the trunk 41. In the second end region of each link mechanism 27, a pair of pivoting axles 45 project coaxially with each other from the outer sides of the arms 37, 39 in the same direction as the sliding axles 43. Further, on one arm 37 of each link mechanism 27, a tooth 47 is provided on the distal end surface of the second end region near the pivoting axis 45, and on the other arm 39, two teeth 49 are provided on the distal end surface of the second end region near the pivoting axis 45. In each link mechanism 27, the end regions (or the first end region) of the arms 37, 39, including the sliding axles 43, constitute a sliding part 51.

As shown in FIGS. 4 and 5, the key-switch device 11 includes a first base 21, a key top 5 arranged above the first base 21, a pair of link members 27 interlocked to each other to support the key top 5 above the first base 21 and direct the key top 5 in a vertical or up-and-down direction, and a switch mechanism 10 capable of opening and closing a contact section 9 of an electric circuit in accordance with the vertical movement of the key top 5. In the key switch 11, the upper surface 53 of the membrane switch sheet 25 constituting the switch mechanism 10 is exposed below the key top 5.

The first base 21 is a rigid member in the shape of a flat plate such as a separate thin metal plate formed of a sheet metal material. The first base 21 supports, on the generally flat upper surface 55 thereof, the membrane switch sheet 25 in a stationary state. The first base 21 further includes two pairs of guide sections 57 for respectively guiding the sliding parts 51 of the link mechanism 27 during the vertical movement of the key top 5. These guide sections 57 are plate-like pieces formed by, for example, punching and bending the material of the first base 21, and are respectively arranged at positions corresponding to the guide sections 51.

A guide hole 59 is formed in each guide section 57 to penetrate therethrough in the direction of the plate thickness. The guide hole 59 is shaped as an oblong hole extending generally parallel to the upper surface 55 of the first base 21. Each guide section 57 extends through the corresponding through-hole 61 provided in the membrane switch sheet 25 to project above the membrane switch sheet 25. The guide hole 59 of each guide section 57 is also disposed to be exposed above the upper surface 53 of the membrane switch sheet 25 (FIG. 4). Two guide sections 57 forming each pair are spaced apart from each other by a distance permitting a first end region of each link mechanism 27 to be inserted therebetween (FIG. 4). The sliding part 51 at the first region of the link mechanism 27 is slidably engaged by the sliding axles 43 with the guide holes 59 of the guide sections 57. The punched holes 62, formed in the first base 21 at the instant when the guide sections 57 are formed by punching the material of the first base 21, are somewhat displaced from the through-holes 61 of the membrane switch sheet 25.

Each of the link mechanisms 27 is disposed between the first base 21 and the key top 5 with the sliding axles 43 provided in the first end region slidably fitted into the guide holes 59 of the respective guide sections 57 of the first base 21, and with the pivoting axles 45 provided in the second end region pivotally fitted into the bearing holes (not shown) of the respective pivot-support sections 63 of the key top 5. The pair of link mechanism 27 are configured to be rotatable in a mutually interlocking manner, through an interlocking structure formed by intermeshing one tooth 47 of the respective one arm 37 with two teeth 49 of the respective other arm 39, about respective pivot axes 65 defined by the pivoting axles 45 of the arms 37, 39.

Figure 6:
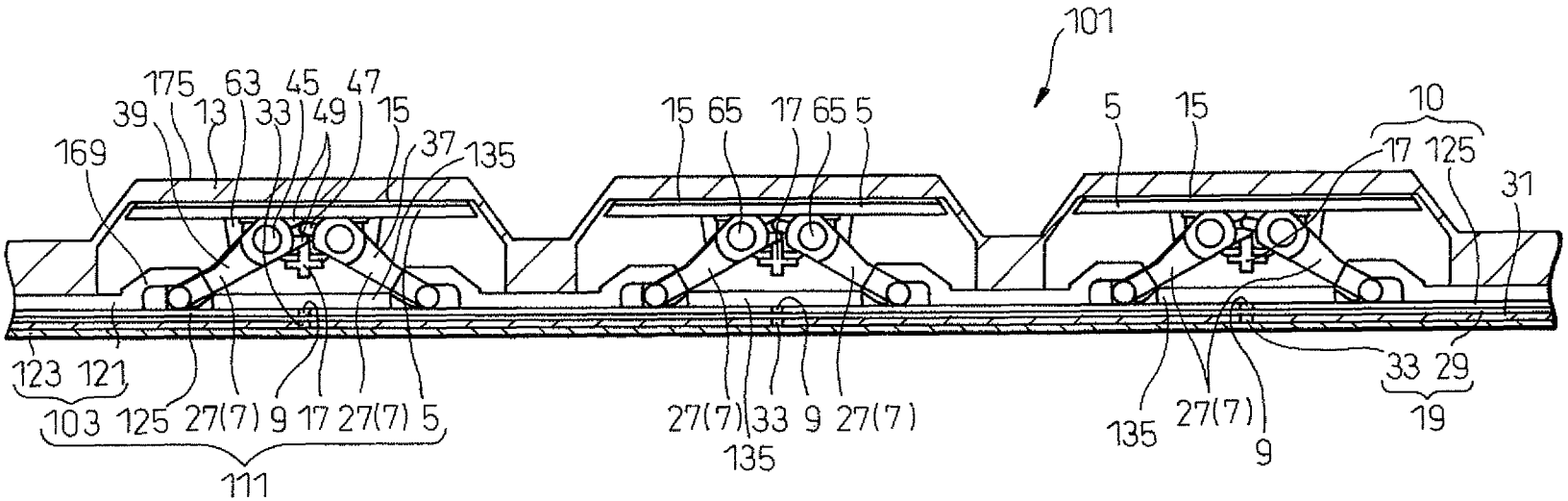
FIG. 6 is a sectional view of the second embodiment of the keyboard 101, which corresponds to the drawing taken along the line III-III shown in FIG. 1.
Figure 7:
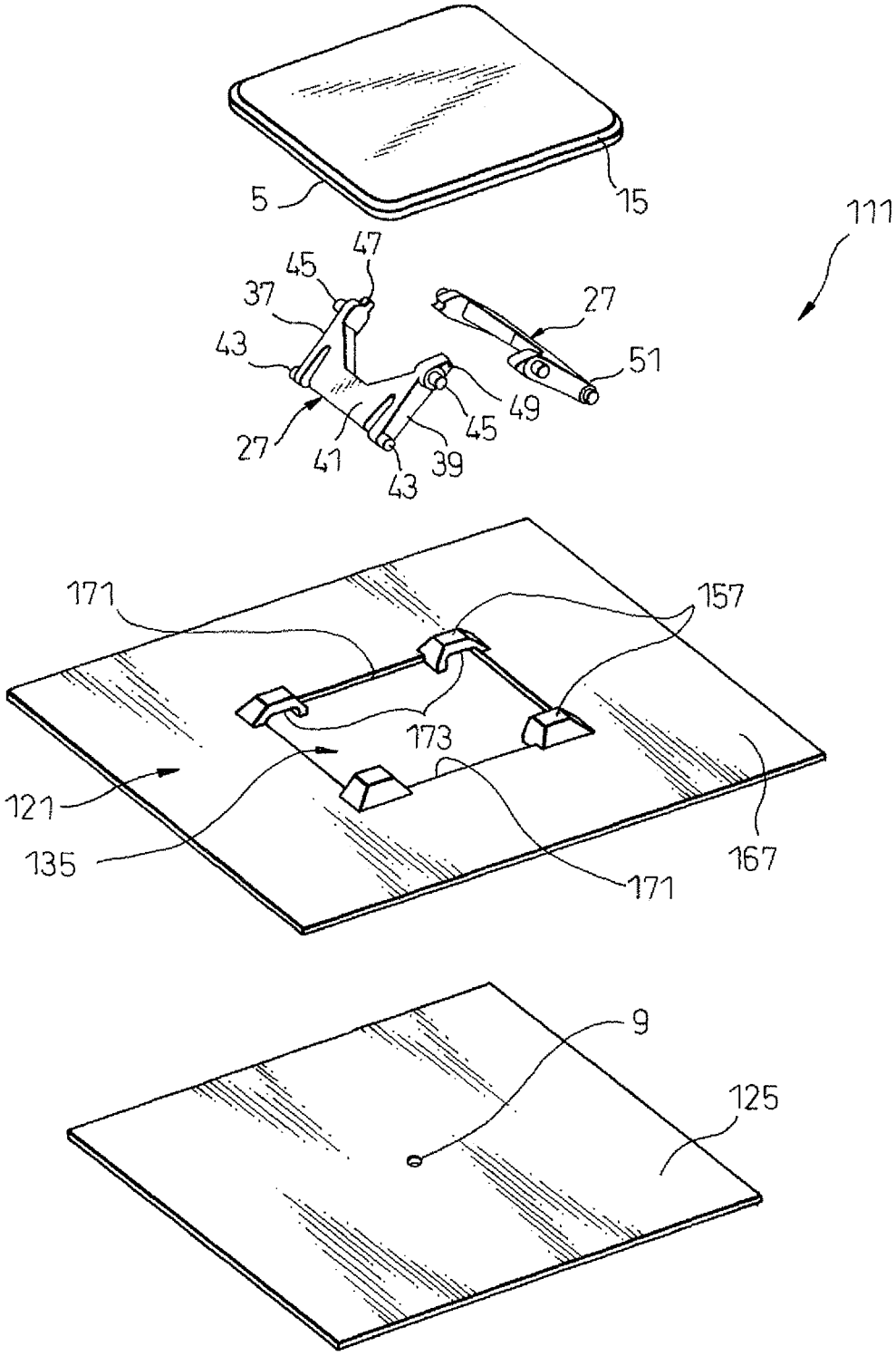
FIG. 7 is an exploded perspective view of one part of the key switch of FIG. 4; and, FIG. 8 is an exploded perspective view of the keyboard 201 according to the third embodiment of the invention.

Referring to FIG. 6, a sectional view of the second embodiment of the keyboard 101, which corresponds to the drawing taken along the line III-III shown in FIG. 1 is presented. Referring to FIG. 7, an exploded perspective view of one part of the key switch 111 of FIG. 6 is presented. The keyboard 101 has substantially the same structure as that of the keyboard 1 according to the first embodiment except that the first base 121 is a flat frame-like member formed from, e.g., an integrally molded unitary piece of a resinous material. Therefore, the components corresponding to those of the keyboard 1 are denoted by common reference numerals, and their descriptions are omitted. The keyboard 101 includes: a base 103 having a first base 121 and a second base 123; a membrane switch sheet 125 between the first and second bases 121 and 123; a light-guide plate 29; and a light source 33 disposed on a flexible printed board 31, as shown in FIGS. 6 and 7. Also, this example can offer the same effect as described above. Furthermore, the first base 21 is a flat frame-like member formed from, e.g., an integrally molded unitary piece of a resinous material. As shown in FIGS. 6 and 7, the first base 121 may have an opening 135 transmitting light from the illuminating mechanism 19. Therefore, the illuminating mechanism 19 can exclusively illuminate the key top 5. Also, the membrane switch sheet 125, at least the portions overlapping with the opening 135 of the first base 121, may be formed from a transparent or semi transparent resinous material. Therefore, light from the light source 33 is never blocked.

The first base 121 is a flat frame-like member formed from, e.g., an integrally molded unitary piece of a resinous material, and includes the generally rectangular opening 135 adapted to be concealed by the key top 5. The first base 121 is provided at the four corners of the opening 135 with two pairs of guide sections 157 having a mutually identical structure. Each guide section 157 includes a wall portion 169 extending from the major surface 167 of the first base 121 internally into the opening 135 like an overhang, and a guide groove 173 extending generally parallel to the major surface 167 along each of a pair of opposing inner edges 171 defining the opening 135 is formed inside the wall portion 169 (FIG. 7). Two guide sections 157 constituting each pair are spaced apart from each other by a distance permitting the first end region of each link mechanism 27 to be inserted therebetween. The sliding part 51 of the first end region of the link mechanism 27 is slidably engaged at the sliding axles 43 with the guide grooves 173 of the guide sections 157.

Each of the link mechanisms 27 is disposed between the second base 123 and the key top 5 with, as described above, the sliding axles 43 provided in the first end region slidably fitted into the guide grooves 173 of the respective guide sections 157 of the first base 121, and with the pivoting axles 45 provided in the second end region pivotally fitted into the bearing holes (not shown) of the respective pivot-support sections 63 of the key top 5. The pair of link mechanism 27 are configured to be rotatable in a mutually interlocking manner, through an interlocking structure formed by intermeshing one tooth 47 of the respective one arm 37 with two teeth 49 of the respective other arm 39 thereof, about respective pivot axes 65 defined by the pivoting axles 45 of the arms 37, 39 (FIG. 6).

Thus, when the link mechanisms 27 synchronously rotate in opposite directions about respective pivot axes 65 and the respective sliding parts 51 slide in a generally horizontal direction under the guiding action of the corresponding guide sections 157 on the first base 121 (i.e., under the sliding engagement of the sliding axle 43 with the guide groove 173), the key top 5 is subjected to a parallel displacement in a generally vertical direction relative to the first base 121, while keeping a predetermined, generally horizontal posture of the key top 5 wherein the operating surface 175 is substantially parallel to the major surface 167. More specifically, the uppermost position of the keying stroke (i.e., the stroke of the vertical movement) of the key top 5 is determined at the instant when the sliding motion of the sliding axles 43 of the link mechanisms 27 toward each other is stopped by the wall portions 169 of the associated guide sections 157 of the first base 121. As the key top 5 descends from this uppermost position, the sliding parts 51 of the link mechanisms 27 slide, under the guiding action of the associated guide sections 157, away from each other in a direction generally perpendicular to the direction of vertical movement of the key top 5. When the key top 5 reaches the lowermost position of the keying stroke, the contact section 9 of the switch mechanism 10 is closed.

In an example of the modification, each key top 5, each guide member 27 and each push-down part 17 may be formed from a transparent resinous material (for example, acrylonitrile butadiene styrene (ABS resin), polycarbonate (PC), and acrylic etc.).

Therefore, light for illumination is never blocked by the above members, and the brightness of illumination can be lowered in comparison to that when the above members are not formed from a transparent resinous material. Thus, the power consumption can be kept lower.

Figure 8:
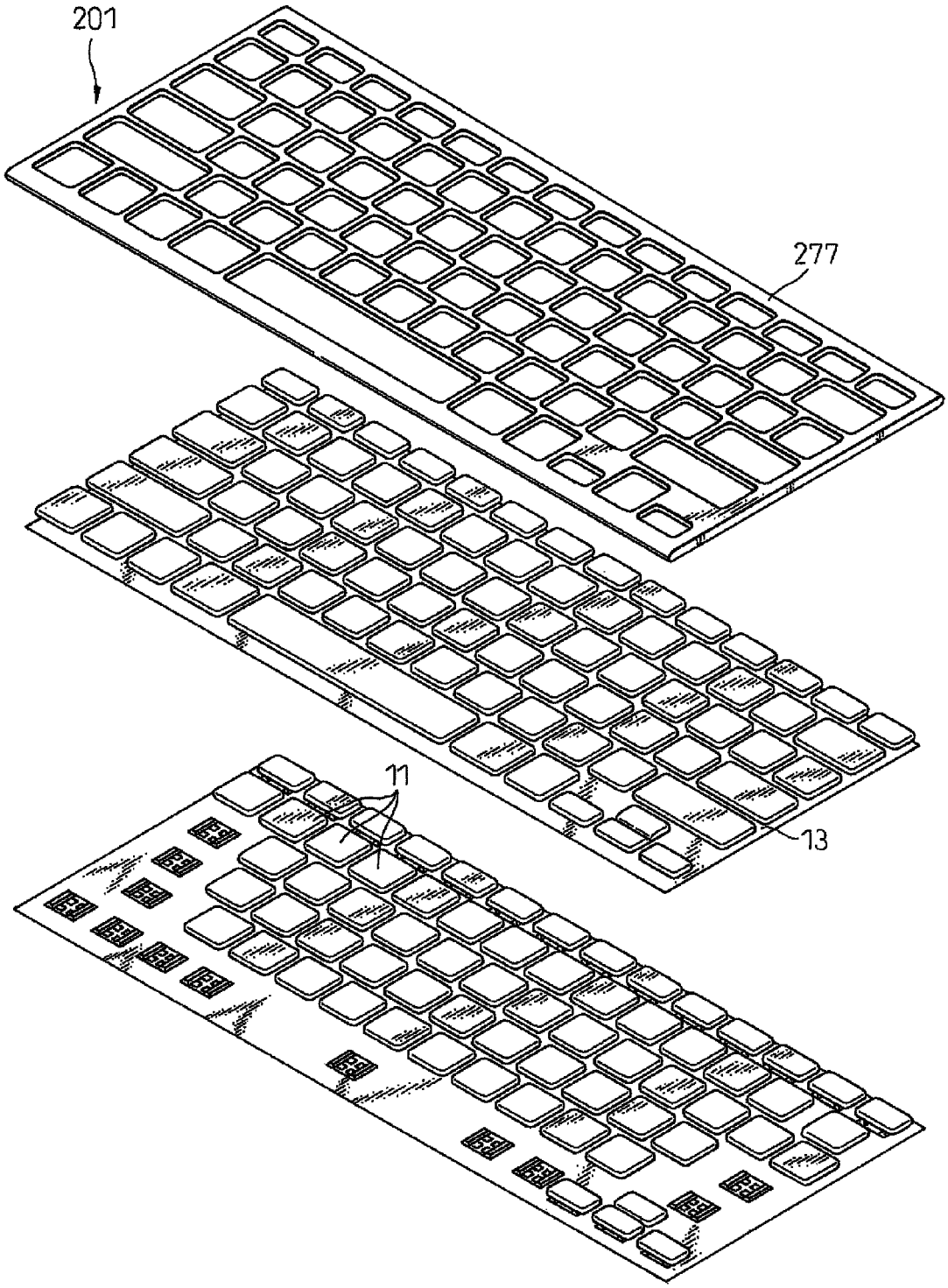

Referring to FIG. 8, an exploded perspective view showing a keyboard 201 according to the second embodiment of the invention is presented. The keyboard 201 has substantially the same structure as that of the keyboard 101 according to the first embodiment except that it has a lattice-like member 277 further. Therefore, the components corresponding to those of the keyboard 1 are denoted by common reference numerals, and their descriptions are omitted.

On a rubber sheet 13 that the keyboard 201 has the lattice-like member 277 for preventing a key-operation mistake is disposed. This allows a user to press each key-switch device.

What is claimed is:

1. A keyboard comprising:

a set of key-switch devices having a base, each key-switch device including a flat plate-like key top disposed above the base;

a guide member located on the base guiding the key top along up and down directions; and a switch mechanism opening and closing a contact of an electric circuit in response to upward and downward actions of the key top; and a rubber sheet fixed along flat top surfaces of the flat plate-like key tops of the set of key-switch devices, which elastically urges the key tops upward so that the key tops are borne away from the base, the rubber sheet being fixed along the flat top surface of each of the flat plate-like key tops by a plurality of adhesive layers disposed directly between the rubber sheet and each respective flat top surface, wherein the guide member of each key-switch device includes a pair of link mechanisms meshed with each other in a gearing manner, each link mechanism being pivotally connected at an end thereof to a flat bottom surface of the respective key top, wherein each key top is provided at the flat bottom surface with pivot-support sections connected to the respective link mechanisms and a push-down part projecting alongside the pivot-support sections for opening and closing the respective contact, and wherein the rubber sheet is arranged so as to cover the set of key-switch devices from outside and define a plurality of closed spaces for each of the set of key-switch devices, respectively, each closed space accommodating the key top and the link mechanisms of each respective key-switch device.

2. The keyboard according to claim 1, further comprising a lattice-like member disposed on the rubber sheet, which prevents the key-switch device adjacent to the desired one from being operated by mistake.

3. The keyboard according to claim 1, further comprising an illuminating mechanism provided adjacent to the base for illuminating the set of key-switch devices.

4. The keyboard according to claim 3, wherein the key top, the guide member and the push-down part of each key-switch device are formed from a transparent resinous material.

5. The keyboard according to claim 3, wherein the base is formed from a metal material and has an opening transmitting light from the illuminating mechanism.

6. The keyboard according to claim 3, wherein the base is formed from a resinous material and has an opening transmitting light from the illuminating mechanism.

* * * * *